United States Patent [19]

Worley et al.

[11] Patent Number: 5,062,767

[45] Date of Patent: Nov. 5, 1991

[54] SEGMENTED COMPOSITE INNER SHROUDS

[75] Inventors: Kevin L. Worley, Palm Beach Gardens; John L. Mayers, Lake Park; Herbert L. Burchette, West Palm Beach, all of Fla.

[73] Assignee: The United States of America as represented by the Secretary of the Air Force, Washington, D.C.

[21] Appl. No.: 516,493

[22] Filed: Apr. 27, 1990

[51] Int. Cl.[5] ..... F01D 5/00

[52] U.S. Cl. ..... 415/209.3; 415/190; 415/200

[58] Field of Search ..... 415/208.1, 209.3, 209.4, 415/210.1, 200, 185, 186, 191, 190; 416/214 A

[56] References Cited

U.S. PATENT DOCUMENTS

| | | | |
|---|---|---|---|
| 1,362,074 | 12/1920 | Baumann | 416/214 A |
| 2,686,655 | 8/1954 | Schörner | 415/200 |
| 3,970,318 | 7/1976 | Tuley | 277/26 |
| 4,365,933 | 12/1982 | Langer et al. | 415/200 |
| 4,646,810 | 3/1987 | Lardellier | 415/200 |
| 4,701,102 | 10/1987 | Pisz et al. | 415/136 |
| 4,759,687 | 7/1988 | Miraucourt | 415/209.5 |

FOREIGN PATENT DOCUMENTS

| | | | |
|---|---|---|---|
| 735184 | 5/1943 | Fed. Rep. of Germany | 416/214 A |

*Primary Examiner*—Edward K. Look
*Assistant Examiner*—Michael S. Lee
*Attorney, Agent, or Firm*—Jacob N. Erlich; Donald J. Singer

[57] ABSTRACT

A shroud for supporting the vanes in the hot sections of a gas turbine engine is comprised of composite segments retained in a metal ring. The metal ring has a positive coefficient of expansion, while the segments have a zero (or much smaller) coefficient. When the ring is heated and grows, it carries the segments with it, so that there is an apparent corresponding growth of the segments.

2 Claims, 1 Drawing Sheet

SEGMENTED COMPOSITE INNER SHROUDS

STATEMENT OF GOVERNMENT INTEREST

The invention described herein may be manufactured and used by or for the Government for governmental purposes without the payment of any royalty thereon.

BACKGROUND OF THE INVENTION

In a conventional gas turbine engine, the air is compressed to high pressure and temperature by the compressor section. In this section, the vanes guiding the air to turn the compressor are frequently mounted on stems so they can be pivoted to adjust to various compressor flows and rotational speeds. The gases passing through the pivoted vanes are very hot, and the shrouds holding them are subject to thermal growth.

In recent years, new light weight ceramics and other composite materials have been developed which are very strong, lightweight and have superior high temperature wear and friction characteristics, and which, therefore, are useful in reducing the overall weight of many components. Such materials have utility in the shrouds used to support the pivoted vanes in the compressor. However, since many of the ceramic and other composite materials used in this application have almost no thermal growth, a problem is created in that other of the engine components do grow with temperature, and the failure of the shroud to grow in a similar manner can deteriorate engine performance. This invention obtains a desired thermal "growth" of a thermally unresponsive material by controlling such growth with a thermally responsive material.

OBJECTS OF THE INVENTION

It is the primary object of this invention to obtain a desired thermal "growth" of a thermally unresponsive material by controlling such growth with a thermally responsive material.

It is another object of this invention to provide in the annular flow path of the compressor of a gas turbine engine a set of vanes supported in a shroud forming the internal diameter of the flow path, said shroud comprising a thermally responsive metal ring in combination with a segmented composite ring, the metal ring controlling the diameter of the segmented ring to aid in controlling knife edge clearances, and to reduce leakage at the internal diameter of the flow path.

Another object of this invention is to provide a shroud for the vanes in the flow path of the compressor of a gas turbine engine, said shroud combining the advantage of the lower weight of a ceramic material, and the apparent thermal growth of a metal material.

Still another object of this invention is to provide a shroud for supporting airfoil members positioned within the hot gas flow path of a rotary gas turbine engine, the combination comprising a multi-piece ring having a c-shaped cross section and a positive coefficient of thermal expansion and a lightweight ceramic ring with a low/small coefficient of expansion consisting of a plurality of abutting segments, the segments being held within the c-shaped cross section of the multi-piece ring, whereby expansion of the multi-piece ring results in the separation of said abutting segments, and the apparent growth thereof.

SUMMARY OF THE INVENTION

In accordance with this invention, the shroud for supporting the vanes of a gas turbine engine is constructed of a ring of ceramic segments all of which are contained within a metal ring. The metal ring has a positive coefficient of expansion, while the segmented ring is made of a composite material having a low/small coefficient of expansion. The guide vanes which may be pivoted are supported by the segments. Radial expansion of the metal ring carries the segments with it, causing the segments to spread slightly, thus producing a radial growth commensurate with the growth of the metal ring. The expansion of the segments reduces leakage at the internal diameter of the flow path, and in addition the use of the composite material significantly reduces component weight. Therefore, the use of the metal ring in combination with the composite segments has the advantages of both materials, but reduces, or eliminates their disadvantages.

BRIEF DESCRIPTION OF THE DRAWINGS

For further objects of this invention, and for a clearer understanding of the nature and advantages thereof, reference should now be made to the following specification and to the accompanying drawings, in which.

DESCRIPTION OF A PREFERRED EMBODIMENT

Figure 1:
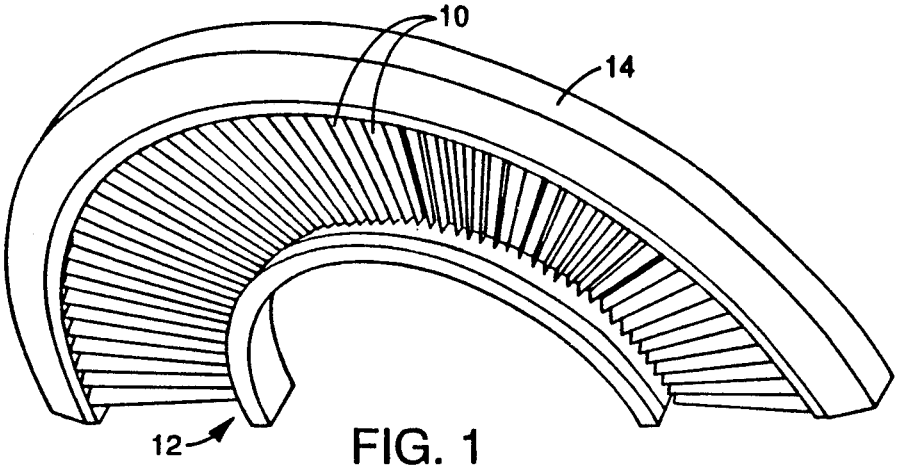
FIG. 1 is a perspective view showing one-half of the variable vanes in the flow path of the compressor of a gas turbine engine.

Referring to FIG. 1 of the drawings, one-half of the pivoted vanes 10 are shown supported by inner and outer shrouds 12 and 14 in the input to a compressor wheel (not shown). While this invention is shown as incorporated in the inner shroud 12, it is understood that the invention may also be incorporated in the outer shroud, or used in many other applications.

Figure 2:
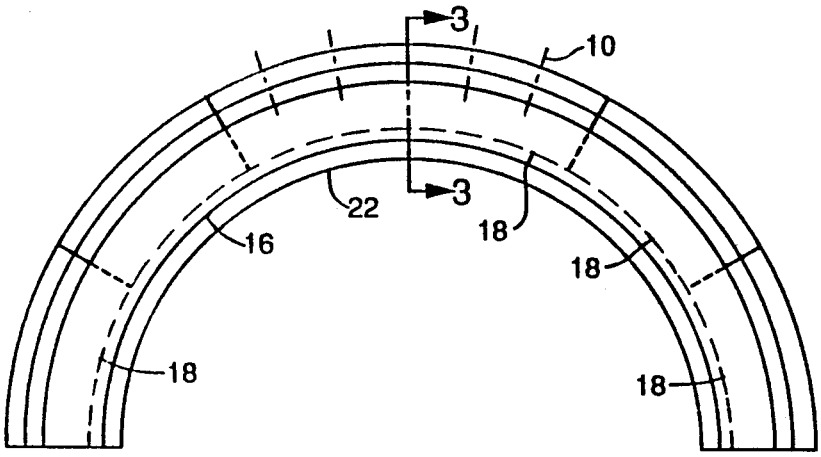
FIG. 2 is a view showing the inner shroud which supports the variable vanes.
Figure 3:
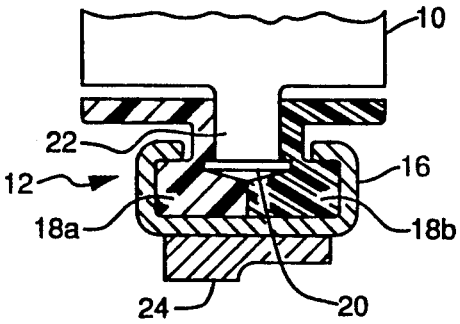
FIG. 3 is a section taken through the line 3—3 in FIG. 2.
Figure 4:
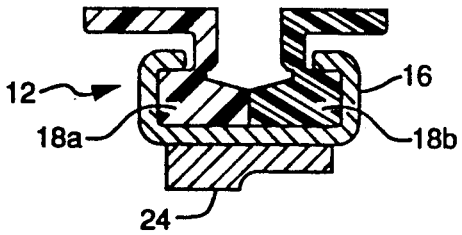
FIG. 4 is a view similar to FIG. 3, but with the vane removed.

The details of the inner shroud are shown in FIGS. 2, 3 and 4 to which reference is now made. In practice, the shroud is built in two half circles which come together at the engine split line. Only one half circle is shown. The inner shroud 12 comprises a c-shaped metal ring 16 which contains a plurality of abutting segments 18 which, when assembled, form a segmented circle within the ring 16.

As seen in FIGS. 3 and 4, each of the segments 18 is split circumferentially into segment halves **18*a* and 18*b*. The segment are bored and grooved to receive the stem 22 and head 20 of each vane. The heads 20 on the stems 22 of the vanes 10 are first captured and held in each of the segments 18, and are then assembled by sliding the segments 18*a* and 18*b* along with the vanes into the ring 16. In practice, each segment might support as many as eight vanes 10 which may be fixed or variable. The metal ring 16 also supports a seal land 24**.

When assembled, the metal ring 16 supports composite segments which, in turn, support the vane stems. As the metal ring grows thermally (which is desirable for controlling clearances), it will also cause the composite ring to grow circumferentially. The outward growth of the composite ring will reduce leakage effects which would occur if the ring did not grow. Thus, using a thermally responsive metal ring to control the diameter of a segmented composite ring aids in controlling clearances, and reduces leakage at the internal diameter of the flow path. Also, the use of a composite material, which previously had not been possible due to low thermal growth, will allow a substantial weight savings over an all metal shroud.

In summary, this invention provides a shroud for supporting guide vanes in the hot sections of a gas turbine engine, the shroud comprising composite segments retained in a metal ring, the thermal growth of the metal ring carrying the segments with it, so that there is an apparent corresponding growth of the segments. While the segments are described herein as having a small coefficient of expansion, it is contemplated that the invention will have utility in any situation where the thermal growth of the metal ring is substantially greater than the thermal growth of the ceramic segments.

It is apparent that this invention will be subject to various modifications and adaptations without departing from its spirit. While this discussion describes a compressor, this invention is applicable to the turbine section or any other machine of round or any other shape where it is desirable to control the thermal growth of an element. It is intended therefore, that this invention be limited only by the following claims as interpreted in the light of the prior art.

What is claimed is:

1. A shroud for supporting airfoils positioned within the hot gas flow path of a gas turbine engine, comprising:

a plurality of said airfoils; and a metal ring having a C-shaped cross section and a positive coefficient of thermal expansion, said metal ring being formed of two half circles;

a lightweight ceramic ring comprised of a plurality of abutting and touching ceramic segments, said ceramic segments being movably contained within the C-shaped cross section of said metal ring, said each ceramic segment also being formed in two circumferential halves, said metal ring further enveloping said ceramic segments on more than three sides of the ceramic segment cross section, said segments having a coefficient of expansion substantially less than said coefficient of expansion of said metal ring, said airfoils being supported in said flow path from said ceramic segments, whereby expansion of said metal ring results in the separation of said abutting, previously touching ceramic segments and the apparent growth of said segments.

2. The invention as defined in claim 1, wherein the thermal coefficient of expansion of said segments is substantially equal to zero.

* * * * *